US011351778B2

(12) United States Patent
Mizuno

(10) Patent No.: US 11,351,778 B2
(45) Date of Patent: Jun. 7, 2022

(54) LIQUID EJECTION HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 66 days.

(21) Appl. No.: 16/890,751

(22) Filed: Jun. 2, 2020

(65) Prior Publication Data

US 2020/0384765 A1 Dec. 10, 2020

(30) Foreign Application Priority Data

Jun. 6, 2019 (JP) ..... JP2019-106070

(51) Int. Cl.
*B41J 2/14* (2006.01)

(52) U.S. Cl.
CPC .... *B41J 2/1404* (2013.01); *B41J 2002/14169* (2013.01); *B41J 2002/14185* (2013.01); *B41J 2002/14387* (2013.01)

(58) Field of Classification Search
CPC ..... B41J 2/1404; B41J 2/14233; B41J 2002/14387; B41J 2002/14185; B41J 2002/14169; B41J 2002/14241; B41J 2202/08; B41J 2002/14419; B41J 2/14016
See application file for complete search history.

(56) References Cited

U.S. PATENT DOCUMENTS 10,093,102 B2 10/2018 Kimura
2018/0086084 A1* 3/2018 Kimura ..... B41J 2/04531

FOREIGN PATENT DOCUMENTS

JP 2018-051768 A 4/2018

* cited by examiner

*Primary Examiner* — Kristal Feggins
(74) *Attorney, Agent, or Firm* — Banner & Witcoff, Ltd.

(57) ABSTRACT

A liquid ejection head includes a flow channel structure, a supply channel structure, and a particular heater. The flow channel structure defines an ejection channel that leads liquid toward a plurality of nozzles arranged in a nozzle row along a first direction. The supply channel structure defines a supply channel configured to allow liquid to flow therefrom to the ejection channel. The particular heater is configured to heat liquid. The flow channel structure is made of inorganic material having a higher thermal conductivity than material used for the supply channel structure. The flow channel structure includes an end portion protruding outward relative to a side surface of the supply channel structure. The particular heater is disposed at the end portion of the flow channel structure.

15 Claims, 4 Drawing Sheets

LIQUID EJECTION HEAD

CROSS-REFERENCE TO RELATED APPLICATION

This application claims priority from Japanese Patent Application No. 2019-106070 filed on Jun. 6, 2019, the content of which is incorporated herein by reference in its entirety.

TECHNICAL FIELD

Aspects of the disclosure relate to a liquid ejection head that ejects liquid such as ink and that is included in a liquid ejection apparatus.

BACKGROUND

Known liquid ejection apparatuses include, for example, inkjet printers. Some known liquid ejection apparatuses are configured to eject ink toward a medium such as a recording sheet from a liquid ejection head (hereinafter, simply referred to as the "head") to form an image on the medium. Such a head may include a heater that is configured to heat a supply channel structure that allows liquid to flow therethrough.

For example, a known head includes a flow channel structure, a supply channel structure, and heaters. The flow channel structure includes ejection channels that lead ink toward nozzles. The supply channel structure includes supply channels that allow ink to flow therefrom to the ejection channels. The heaters are configured to heat the supply channel structure. The supply channel structure (e.g., a case substrate) is made of synthetic resin. The flow channel structure (e.g., a communication substrate) is made of inorganic material such as silicon. In the known head, the flow channel structure and the supply channel structure are joined to each other using a thermosetting adhesive. In such a known head, the supply channel structure may be caused to be expanded by heat generated by the heaters, thereby reducing residual stress that may arise in the known head due to difference in thermal contraction between the flow channel structure and the supply channel structure after the thermosetting adhesive is set.

In order to eject relatively high viscosity ink from nozzles effectively, ink may need to be heated to be at a temperature slightly higher than room temperature (e.g., approximately 40 degrees Celsius) to cause ink to have a suitable viscosity. The known head is configured to apply heat to the supply channel structure using the heaters to heat ink in the supply channel structure.

SUMMARY

The supply channel structure of the known head may be made of synthetic resin and the supply channel structure may have a lower thermal conductivity than the flow channel structure. Thus, it may be hard to transfer heat generated by the heaters disposed at the supply channel structure, to ink. Consequently, it may be difficult to heat ink effectively.

Accordingly, aspects of the disclosure provide a liquid ejection head that may include a flow channel structure and a supply channel structure and in which liquid may be heated appropriately.

In one or more aspects of the disclosure, a liquid ejection head may include a flow channel structure, a supply channel structure, and a particular heater. The flow channel structure may define an ejection channel that may lead liquid toward a plurality of nozzles arranged in a nozzle row along a first direction. The supply channel structure may define a supply channel configured to allow liquid to flow therefrom to the ejection channel. The particular heater may be configured to heat liquid. The flow channel structure may be made of inorganic material having a higher thermal conductivity than material used for the supply channel structure. The flow channel structure may include an end portion protruding outward relative to a side surface of the supply channel structure. The particular heater may be disposed at the end portion of the flow channel structure.

According to the one or more aspect of the disclosure, in the liquid ejection head having the above configuration, the heater may be disposed at the end portion of the flow channel structure protruding outward relative to the side surface of the supply channel structure. That is, the heater may be disposed at the flow channel structure having a higher thermal conductivity than the supply channel structure. Such a configuration may thus enable the heater to apply heat to the supply channel (e.g., a manifold) of the supply channel structure effectively, thereby heating liquid such as ink appropriately.

With such a configuration, the one or more aspects of the disclosure may thus provide a liquid ejection head that may include a flow channel structure and a supply channel structure and in which liquid may be heated appropriately.

DETAILED DESCRIPTION

Figure 1:
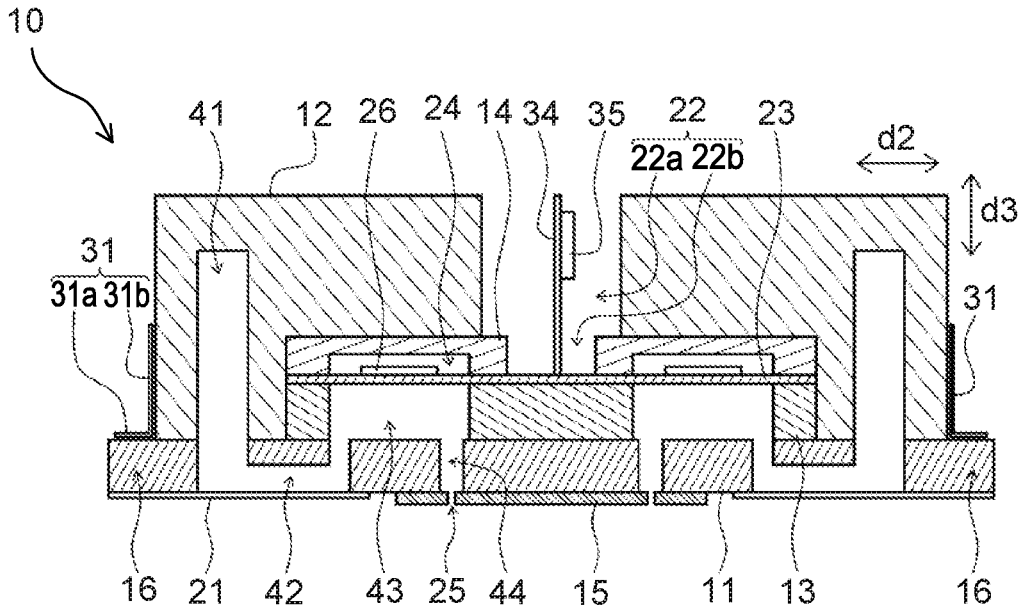
FIG. 1 is a schematic sectional view illustrating a general configuration of a liquid ejection head (hereinafter, simply referred to as the "head") according to an illustrative embodiment of the disclosure.

Hereinafter, an illustrative embodiment of the disclosure will be described with reference to the accompanying drawings. As used throughout this disclosure and the drawings, the same or similar elements will be indicated by common reference numerals or letters. Therefore, one of the same or similar elements may be described in detail, and description for the others may be omitted.

Configuration of Liquid Ejection Head

Figure 2:
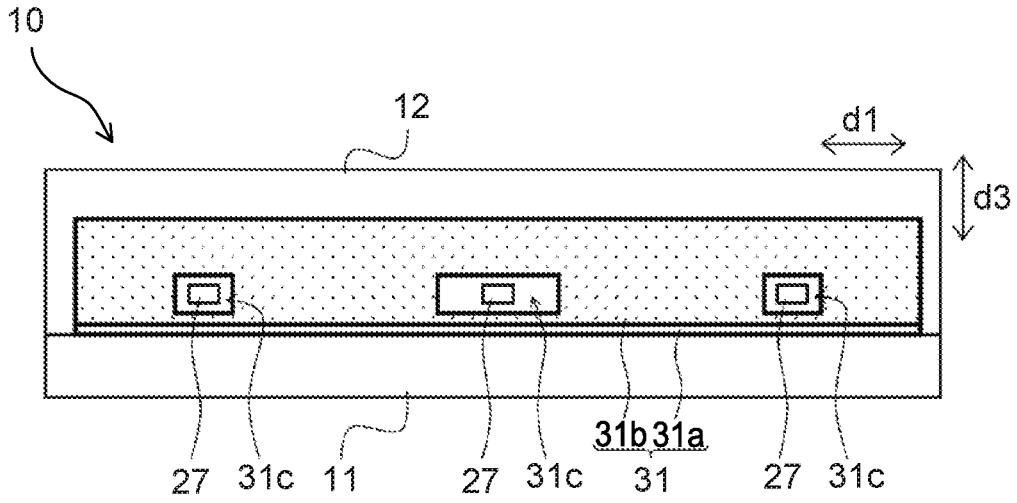
FIG. 2 is a schematic side view of the head of FIG. 1 according to the illustrative embodiment of the disclosure.

Referring to FIGS. 1 and 2, an example liquid ejection head 10 (hereinafter, simply referred to as the "head") according to an illustrative embodiment will be described. As illustrated in FIG. 1, the head 10 includes a flow channel structure 11, a supply channel structure 12, an actuator substrate 13, a support substrate 14, a nozzle substrate 15, dampers 21, an elastic layer 23, piezoelectric elements 26, heaters 31, a wiring substrate 34, and a drive IC 35. As illustrated in FIG. 2, the head 10 further includes temperature sensors such as thermistors 27.

The flow channel structure 11 may have a flat plate like shape. The flow channel structure 11 may have longer sides and shorter sides. A direction in which the longer sides of the flow channel structure 11 extend may be referred to as a longitudinal direction. The flow channel structure 11 is fixed to the supply channel structure 12. The flow channel structure 11 has one surface (e.g., an upper surface) and another surface (e.g., a lower surface). The actuator substrate 13 and the support substrate 14 are disposed between the flow channel structure 11 and the supply channel structure 12 and are fixed to the upper surface of the flow channel structure 11. The nozzle substrate 15 and the damper members 21 are fixed to the lower surface of the flow channel structure 11. The flow channel structure 11 includes end portions 16 protruding outward relative to respective side surfaces of the supply channel structure 12 being fixed to the supply channel structure 12. On each side of the head 10, the first heater 31 is attached to both of the end portion 16 and the particular side surface of the supply channel structure 12.

FIG. 1 illustrates a cross section of the head 10 in a direction orthogonal to the longitudinal direction. Assuming that the longitudinal direction is defined as a length direction and a direction orthogonal to the longitudinal direction is defined as a transverse direction and a direction orthogonal to the length direction and the transverse direction is defined as an up-down direction, FIG. 1 illustrates a cross section of the head 10 in a plane extending both in the transverse direction and in the up-down direction. In FIG. 1, the head 10 is thus elongated in the transverse direction. In FIG. 1, the flow channel structure 11 is disposed below the supply channel structure 12. In other words, the supply channel structure 12 is disposed above the flow channel structure 11. In the description below, directions of "up" and "down" may be defined with reference to the positional relationship between the flow channel structure 11 and the supply channel structure 12.

In the head 10 illustrated in FIG. 1, the nozzle substrate 15 and the dampers 21 are joined to the lower surface of the flow channel structure 11 and the actuator substrate 13 and the support substrate 14 are joined to the upper surface of the flow channel structure 11 together with the supply channel structure 12. The head 10 may basically have a symmetric structure with respect to the cross section of the head 10 in the transverse direction. Therefore, a configuration of one of the halves of the head 10 will be described and description for the other half will be omitted.

For describing the positional relationship in the head 10, the longitudinal direction, that is, the length direction may be defined as a first direction regarded as a reference direction. The transverse direction may be a right-left direction. The right-left direction may be defined as a second direction. The up-down direction may be defined as a third direction. The first direction is indicated by a double-headed arrow d1 in FIG. 2. The second direction is indicated by a double-headed arrow d2 in FIG. 1. The third direction is indicated by a double-headed arrow d3 in FIGS. 1 and 2. For directions, basically the longitudinal direction may be used. In the description below, when not distinguishing the directions of "up", "down", "right", and "left", the transverse direction may be used. When distinguishing the directions of "up", "down", "right", and "left", the up-down direction or the right-left direction may be used.

The nozzle substrate 15 is disposed at the lower surface of the head 10. The nozzle substrate 15 has a plurality of nozzles 25 arranged along the longitudinal direction (e.g., the direction of the arrow d1 in FIG. 2). In the illustrative embodiment, the nozzles 25 are arranged in two nozzle rows in the nozzle substrate 15. Nevertheless, the number of nozzle rows is not limited to the specific example. A spacing (or pitch) between nozzles 25 in each nozzle row is not limited specifically. Any spacing may be adopted as long as the spacing corresponds to a density of dots to be formed on a recording sheet when the head 10 ejects liquid droplets (i.e., when the head 10 performs printing).

The nozzle substrate 15 is positioned at a middle portion of the lower surface of the head 10 in the right-left direction (e.g., the direction of the arrow d2 in FIG. 1). The dampers 21 are positioned at end portions of the lower surface of the head 10 in the right-left direction. The flow channel structure 11 has openings that may serve as ejection channels 42 that lead ink (e.g., liquid) toward the nozzles 25. The dampers 21 are attached to the lower surface of the flow channel structure 11 to close the openings of the flow channel structure 11 to define the ejection channels 42.

The actuator substrate 13 is laminated on a middle portion of the upper surface of the flow channel structure 11 in the right-left direction. The elastic layer 23 is laminated on an upper surface of the actuator substrate 13. The support substrate 14 is laminated on an upper surface of the elastic layer 23. The support substrate 14 has cavities 24. Each cavity 24 may be a recess defined in a lower surface of the support substrate 14. The elastic layer 23 is disposed at the lower surface of the support substrate 14 to close the cavities 24. The piezoelectric elements 26 are disposed in the cavities 24. In other words, the support substrate 14 has recesses at respective positions corresponding to the piezoelectric elements 26. Each recess may have an appropriate size that may allow driving of the piezoelectric elements 26. The recesses may serve as the cavities 24. The piezoelectric elements 26 are disposed on the upper surface of the elastic layer 23. Thus, the piezoelectric elements 26 are positioned at a lower portion of a corresponding closed cavity 24.

The actuator substrate 13 has pressure chambers 43 that may be through holes. The pressure chambers 43 are positioned vertically below the corresponding cavities 24, that is, the respective corresponding piezoelectric elements 26. The elastic layer 23 defines upper surfaces of the respective pressure chambers 43. The flow channel structure 11 defines lower surfaces of the respective pressure chambers 43. The pressure chambers 43 are thus closed by the elastic layer 23 and the flow channel structure 11. The ejection channels 42 of the flow channel structure 11 are in communication with the respective corresponding pressure chambers 43. The flow channel structure 11 further includes nozzle communication channels 44 (e.g., descenders) that may be through holes. The nozzle communication channels 44 are in communication with the respective corresponding nozzles 25. The nozzle communication channels 44 are also in communication with the respective corresponding pressure chambers 43. As illustrated in FIG. 1, a pressure chamber 43 is in communication with a corresponding ejection channel 42 via one end portion of the lower surface of the pressure chamber 43 in the right-left direction. The pressure chamber 43 is also in communication with a nozzle communication channel 44 via the other end portion of the lower surface of the pressure chamber 43 in the right-left direction.

The pressure chambers 43 of the actuator substrate 13 correspond to the respective nozzles 25 defined in the nozzle substrate 15. In the illustrative embodiment, the nozzles 25 of the nozzle substrate 15 are arranged in two rows along the longitudinal direction (e.g., the direction of the arrow d1 in FIG. 2). Thus, the pressure chambers 43 of the actuator substrate 13 are also arranged in two rows along the longitudinal direction to correspond to the respective corresponding nozzles of the nozzle rows. The piezoelectric elements 26 are disposed on the elastic layer 23 in a one-to-one correspondence with the pressure chambers 43. The piezoelectric elements 26 are thus arranged in two rows along the longitudinal direction to correspond to the nozzle rows and the respective pressure chambers 43.

As illustrated in FIG. 1, the supply channel structure 12 is disposed over the flow channel structure 11, the actuator substrate 13 positioned at the upper surface of the flow channel structure 11, and the support substrate 14. The supply channel structure 12 includes supply channels 41 (e.g., manifolds) that are configured to allow ink (e.g., liquid) to flow therefrom to the ejection channels 42 of the flow channel structure 11. The supply channels 41 is elongated in the up-down direction in the cross section in the transverse direction in FIG. 1. Each supply channel 41 is in communication with corresponding ones of the ejection channels 42 via its lower end. The supply channels 41 are connected to an ink cartridge (or ink tank). The supply channels 41 may be supplied with ink from the ink cartridge.

The supply channel structure 12 has a through portion 22*a* at its middle portion in the transverse cross-section. The support substrate 14 has a through portion 22*b* at its middle portion in the transverse cross-section. The through portion 22*a* of the supply channel structure 12 and the through portion 22*b* of the support substrate 14 are elongated along the longitudinal direction. The through portions 22*a* and 22*b* constitute a hollow 22. The upper surface of the actuator substrate 13 is partially exposed through the through portion 22*b* of the support substrate 14.

The supply channel structure 12 partially covers the flow channel structure 11, the actuator substrate 13, and the support substrate 14 while the through portion 22*a* of the supply channel structure 12 allows the through portion 22*b* of the support substrate 14 to be exposed. Such a configuration may thus allow the upper surface of the actuator substrate 13 to be partially exposed through the hollow 22 consisting of the through portions 22*a* and 22*b*.

An electrode trace extends on the upper surface of the actuator substrate 13 from each piezoelectric element 26. The electrode traces of the piezoelectric elements 26 are positioned in the through portion 22*b* of the support substrate 14. The electrode traces of the piezoelectric elements 26 are connected to the wiring substrate 34. The drive IC 35 for driving the piezoelectric elements 26 is mounted on the wiring substrate 34. At least a portion of the wiring substrate 34 and the drive IC 35 are positioned in the hollow 22.

In response to driving of a piezoelectric element 26 by the drive IC 35, a corresponding portion of a vibration plate including the elastic layer 23 is warped to protrude toward a pressure chamber 43. This may cause ink (e.g., liquid) flow from the pressure chamber 43 to a corresponding nozzle 25 via a nozzle communication channel 44, thereby causing ejection of ink (e.g., liquid) from the corresponding nozzle 25. That is, the flow channel structure 11, the actuator substrate 13, the elastic layer 23, and the piezoelectric elements 26 constitute an actuator unit.

On each side of the head 10, the first heater 31 is disposed at at least the end portion 16 of the flow channel structure 11. The first heater 31 is configured to heat ink (or any liquid to be ejected from the head 10). As described above, the end portion 16 protrudes outward relative to a corresponding side surface of the flow channel structure 11 in a state where the flow channel structure 11 is fixed to the supply channel structure 12. In the example illustrated in FIG. 1, the first heater 31 includes a first portion 31*a* and a second portion 31*b*. The first portion 31*a* may be placed at an upper surface of the end portion 16. The second portion 31*b* may be placed at a side surface of the supply channel structure 12. That is, in the illustrative embodiment, the first heater 31 is attached to both of the flow channel structure 11 (e.g., the end portion 16) and the supply channel structure 12.

It is noted that "the end portion 16 protrudes outward" refers to a state where the end portion 16 protrudes outward relative to a corresponding side surface of the flow channel structure 11 in a state where the flow channel structure 11 is fixed to the supply channel structure 12 (or the end portion 16 projects relative to the side surface of the supply channel structure 12 in a direction in which the plate-shaped flow channel structure 11 extends in a state where the flow channel structure 11 is fixed to the supply channel structure 12).

When the head 10 of FIG. 1 is viewed from one of its sides in the second direction (e.g., the direction of the arrow d2), as illustrated in FIG. 2, the first heater 31 (e.g., the first portion 31*a* and the second portion 31*b*) is elongated along the longitudinal direction of the head 10 (e.g., the direction of the arrow d1). The head 10 further includes a plurality of thermistors 27 (e.g., temperature sensors) at the side surface of the supply channel structure 12. In the example illustrated in FIG. 2, the thermistors 27 are disposed at three positions of the side surface of the supply channel structure 12. In FIG. 2, for the purposes of convenience, the dampers 21 and the nozzle substrate 15 attached to the lower surface of the flow channel ember 11 are not illustrated.

In the head 10 having the above configuration, the supply channel 41 (e.g., the manifold) of the supply channel structure 12 may be supplied with ink from the ink cartridge. The supply channel 41 is in communication with corresponding ones of the ejection channels 42 of the flow channel structure 11. The ejection channels 42 are in communication with respective corresponding ones of the pressure chambers 43 arranged in the longitudinal direction. The nozzle communication channels 44 of the flow channel structure 11 and the nozzles 25 of the nozzle substrate 15 are arranged in the longitudinal direction. The pressure chambers 43 are in communication with the respective corresponding nozzles 25 of the nozzle substrate 15 via the respective corresponding nozzle communication channels 44. Such a configuration may thus allow ink supplied to the supply channel 41 to flow therefrom to the pressure chambers 43 via the ejection channels 42.

The piezoelectric elements 26 are disposed at the upper surfaces of the respective corresponding pressure chambers 43. The vibration plate including the elastic layer 23 is disposed to extend over the upper surfaces of the pressure chambers 43. With such a configuration, as a piezoelectric element 26 is driven, ink flows from a pressure chamber 43 to a nozzle 25 via a nozzle communication path 44, thereby causing ejection of ink to the outside of the head 10. While ink flows from the pressure chamber 43 to the nozzle 25, the first heater 31 applies heat to the flow channel structure 11 via at least the end portion 16 to heat ink flowing through the ejection channels 42 or the nozzle communication channels 44. The first heater 31 extends beyond the flow channel structure 11 to the supply channel structure 12, thereby also heating the supply channel 41 (e.g., the manifold) of the supply channel structure 12. Such a configuration may thus also heat ink flowing through the supply channel 41. The first heater 31 is configured to be driven by control of a controller. More specifically, for example, the controller controls driving of the first heater 31 based on temperatures measured by the thermistors 27 (e.g., the temperature sensors).

The configuration of the head 10 is not limited to the specific example such as the head 10 including the flow channel structure 11, the supply channel structure 12, the actuator substrate 13, the support substrate 14, the nozzle substrate 15, the dampers 21, the elastic layer 23, the piezoelectric elements 26, the thermistors 27, and the heaters 31. In other embodiments, a head having any known configuration may be adopted.

The flow channel structure 11 may be a substrate made of, for example, inorganic material. In the illustrative embodiment, for example, the flow channel structure 11 may be a silicon substrate. The ejection channels 42 and the nozzle communication channels 44 of the flow channel structure 11 may be formed by known anisotropic etching or half etching. The supply channel structure 12 may be made of, for example, known resin material. In the illustrative embodiment, for example, the supply channel structure 12 may be made of ABS resin. In another example, the supply channel structure 12 may be made of inorganic material instead of resin material. Examples of the inorganic material include alumina ($Al_2O_3$).

In this disclosure, the flow channel structure 11 may be made of inorganic material having a higher thermal conductivity than the material used for the supply channel structure 12. In a case where the supply channel structure 12 is made of resin material, the flow channel structure 11 may be made of a typical inorganic material (e.g., silicon). Inorganic material has normally a higher thermal conductivity than resin. It has been known that although the thermal conductivity of the ABS resin varies by various conditions (e.g., copolymerization ratio, molecular weight, and additive) or measuring method, the thermal conductivity of ABS resin around room temperature is approximately 0.15 to 0.35 W/mK. It has been also known that although the thermal conductivity of silicon varies by crystal structure (e.g., monocrystal or polycrystal) or measuring method, the thermal conductivity of silicon around room temperature is approximately 140 to 160 W/mK. Thus, in a case where the supply channel structure 12 is made of ABS resin, silicon may be used as the inorganic material used for the flow channel structure 11.

In a case where the supply channel structure 12 is made of inorganic material, the flow channel structure 11 needs to be made of inorganic material having a higher thermal conductivity than the inorganic material used for the supply channel structure 12. For example, in a case where the supply channel structure 12 is made of alumina, the flow channel structure 11 may be made of silicon. It has been known that although the thermal conductivity of alumina varies by type or measuring method, the thermal conductivity of alumina around room temperature is approximately 20 to 40 W/mK. Since the thermal conductivity of silicon is approximately 140 to 160 W/mK, the supply channel structure 12 made of silicon has a higher thermal conductivity than the flow channel structure 11 made of alumina.

In this disclosure, it may be preferable that the thermal conductivity of the material used for the supply channel structure 12 be lower than the thermal conductivity of the material used for the dampers 21. The dampers 21 may be a film made of resin material (e.g., a damper film). For example, the dampers 21 may be made of PPS resin. In a case where resin material is used for the supply channel structure 12, the resin material having a higher thermal conductivity than the resin material used for the dampers 21 may be adopted. By doing so, the thermal conductivity of the supply channel structure 12 and the thermal conductivity of the flow channel structure 11 may be relatively close to each other. Thus, an occurrence of great difference in linear expansion coefficient between the flow channel structure 11 and the supply channel structure 12 at their joint surfaces may be effectively reduced. Consequently, the joint condition of the flow channel structure 11 and the supply channel structure 12 may be maintained in an appropriate condition.

In this disclosure, alumina may be used for the supply channel structure 12. Thus, difference in thermal conductivity may become relatively small between alumina and silicon typically used for the flow channel structure 11. In a case where resin material is used for the supply channel structure 12, a triple-digit difference may arise in a simple numeric comparison of the thermal conductivity. Nevertheless, in a case where alumina is used for the supply channel structure 12, a single-digit difference may arise in a simple numeric comparison of the thermal conductivity. Thus, an occurrence of great difference in linear expansion coefficient between the flow channel structure 11 and the supply channel structure 12 at their joint surfaces may be effectively reduced. Consequently, the joint condition of the flow channel structure 11 and the supply channel structure 12 may be maintained in an appropriate condition.

The actuator substrate 13 may be a substrate made of, for example, inorganic material. In the illustrative embodiment, for example, the actuator substrate 13 may be a silicon substrate. The actuator substrate 13 has a plurality of pressure chambers 43 formed by, for example, anisotropic etching. The pressure chambers 43 correspond to the respective corresponding nozzles 25 defined in the nozzle substrate 15.

The piezoelectric elements 26 are placed in the cavities 24 of the support substrate 14 and are thus protected by the support substrate 14. That is, the support substrate 14 may be a protection substrate for the piezoelectric elements 26. A material used for the support substrate 14 is not limited specifically. Examples of the material used for the support substrate 14 include inorganic materials such as glasses, ceramic materials, silicon monocrystal substrates, and metals, or organic materials such as known resin materials. The nozzle substrate 15 may be, for example, a silicon substrate made of inorganic material. The nozzles 25 arranged in rows (e.g., nozzle rows) may be formed in the nozzle substrate 15 by, for example, dry etching.

The elastic layer 23 may be made of elastic material. In the illustrative embodiment, the elastic layer 23 may be, for example, a silicon dioxide layer having a thickness of approximately 1 μm. An insulating layer made of an insulating material is provided on the elastic layer 23. Examples of the insulating material include zirconium oxide. Nevertheless, the insulating material used for the insulating layer is not limited to the specific example. The piezoelectric elements 26 are positioned on the lamination of the elastic layer 23 and the insulating layer in a one-to-one correspondence with the pressure chambers 43.

The configuration of the piezoelectric elements 26 is not limited specifically. In the illustrative embodiment, for example, the piezoelectric elements 26 has a configuration such that a lower electrode layer, a piezoelectric layer, and an upper electrode layer are laminated one above another on the lamination of the elastic layer 23 and the insulating layer and a pattern is provided by a known patterning method to correspond to the respective pressure chambers 43. The upper and lower electrode layers may be made of, for example, known metal. The piezoelectric layer may be made of, for example, known piezoelectric material including lead zirconate titanate (PZT). One of the upper and lower electrode layers may serve as a common electrode and the other may be serve as individual electrodes. The elastic layer 23, the insulating layer, and the lower electrode layer may serve as a vibration plate configured to vibrate when the piezoelectric elements 26 are driven.

Electrode traces extend from the respective individual electrodes (e.g., the upper electrode layer or the lower electrode layer) on the insulating layer. The electrode traces are connected to the wiring substrate 34. A configuration of the wiring substrate 34 is not limited specifically. In the illustrative embodiment, the wiring substrate 34 may be a known Chip on Film ("COF") substrate. The configuration of the drive IC 35 is not limited specifically. An integrated circuit or a drive element known in the field of liquid ejection head may be suitable. The drive IC 35 is configured to apply a drive signal (e.g., a drive voltage) to a particular portion between the upper electrode layer and the lower electrode layer of a particular piezoelectric element 26 to deform the piezoelectric element 26. This may thus cause the vibration plate including the lower electrode, the insulating layer, and the elastic layer 23 to vibrate.

The type of thermistors 27 attached to the side surface of the supply channel structure 12 is not limited specifically. Any thermistor known in the field of liquid ejection head may be suitable. In another example, a known temperature sensor (e.g., a known thermocouple) may be used instead of the thermistors 27. The configuration of the first heater 31 disposed at least at the end portion 16 of the flow channel structure 11 is not limited specifically. Any heater known in the field of liquid ejection head may be suitable. In the illustrative embodiment, for example, a known sheet heater (e.g., a heater in which copper wires are sandwiched between polyimide films) or a ceramic heater may be used as the first heater 31. The configuration of the controller is not limited specifically. For example, a microcomputer, a CPU of a microcontroller, or any controller having a known configuration including various storages may be used.

The fabrication method of the head 10 is not limited specifically. The head 10 may be fabricated using a known method in which the members such as the flow channel structure 11, the supply channel structure 12, the actuator substrate 13, the support substrate 14, the nozzle substrate 15, the dampers 21, the elastic layer 23, the piezoelectric elements 26, and the thermistors 27 may be fixed or joined to each other. The laminating order in which the members of the head 10 are fixed or joined to each other is not limited specifically. For example, the flow channel structure 11, the dampers 21, and the nozzle substrate 15 may be joined to fabricate a channel unit. The actuator substrate 13, the elastic layer 23, the piezoelectric elements 26, and the support substrate 14 may be joined to fabricate an actuator unit. Then, the channel unit and the actuator unit may be fixed to each other to fabricate the head 10.

The method for fixing or joining the members and/or the units to each other is not limited specifically. In one example, a known adhesive may be usually used. In another example, the members and/or the units may be fixed or joined to each other without using an adhesive. In this disclosure, in a case where the flow channel structure 11 and the supply channel structure 12 are fixed to each other using an adhesive, the adhesive may preferably have a higher thermal conductivity than the material used for the supply channel structure 12.

In a case where the supply channel structure 12 is made of resin material, an adhesive having a higher thermal conductivity than the resin material used for the supply channel structure 12 may be used. More specifically, for example, in a case where the supply channel structure 12 is made of ABS resin material, an epoxy adhesive may be suitable. As compared with a silicone adhesive that may be one of typical adhesives, an epoxy adhesive tends to have a higher thermal conductivity than ABS resin. Thus, using such an epoxy adhesive may effectively reduce an occurrence of great difference in linear expansion coefficient between the flow channel structure 11 and the supply channel structure 12 at their joint surfaces. Consequently, the joint condition of the flow channel structure 11 and the supply channel structure 12 may be maintained in an appropriate condition.

Configuration of Heaters

Referring to FIGS. 1, 2, 3A, and 3B, an example of the heaters 31 of the head 10 will be described in detail. Both of the heaters 31 have the same configuration, and therefore, one of the heaters 31 will be described in detail.

As illustrated in FIGS. 1 and 2, a first heater 31 includes a first portion 31*a* and a second portion 31*b*. The first portion 31*a* is positioned at an upper surface of an end portion 16 of the flow channel structure 11. The second portion 31*b* is positioned at a side surface of the supply channel structure 12. In this disclosure, a portion of the first heater 31 may be attached to at least the end portion 16. As described above, the flow channel structure 11 including the end portion 16 is made of inorganic material having a higher thermal conductivity than the supply channel structure 12, thereby enabling heat generated by the first heater 31 to be transferred to ink (e.g., liquid) flowing through the ejection channel 42 appropriately.

In the example illustrated in FIGS. 1 and 2, another portion (e.g., the second portion 31*b*) of the first heater 31 is also attached to the side surface of the supply channel structure 12. That is, the first heater 31 is attached to both of the flow channel structure 11 and the supply channel structure 12. Such a configuration may thus enable the first heater 31 to heat the supply channel 41 (e.g., the manifold) of the flow channel structure 11 effectively. Consequently, ink held in the supply channel 41 or flowing through the ejection channels 42 may be heated further appropriately.

As illustrated in FIG. 2, the first heater 31 is elongated in the longitudinal direction (e.g., the first direction) of the head 10. In other words, the first heater 31 has longer sides extending along the longitudinal direction. For example, the first heater 31 may have a substantially rectangular shape. In regard to the first heater 31, a dimension of sides (e.g., shorter sides) extending perpendicular to the longitudinal direction (e.g., the direction of the arrow d1 in FIG. 2) may be defined as a width.

As illustrated in FIG. 1, the first portion 31*a* of the first heater 31 is positioned at the upper surface of the end portion 16. Thus, the first portion 31*a* has a width extending along the right-left direction (e.g., the direction of the arrow d2) that may be the transverse direction. The second portion 31*b* of the first heater 31 is positioned at the side surface of the supply channel structure 12. Thus, the second portion 31*b* has a width extending along the up-down direction (e.g., the direction of the arrow d3) that may be the transverse direction. The width of the second portion 31*b* is greater than the width of the first portion 31*a* in its width direction.

Since the second portion 31*b* of the first heater 31 is attached to the side surface of the supply channel structure 12, the second portion 31*b* may have a relatively large width. As described above, the supply channel structure 12 has a relatively lower thermal conductivity than the flow channel structure 11. Thus, it may be hard to heat the supply channel 41 (e.g., the manifold) of the supply channel structure 12. The second portion 31*b* may thus have a relatively large heat generator to heat the supply channel 41 (e.g., the manifold) appropriately.

The first portion 31*a* of the first heater 31 is attached to the end portion 16 of the flow channel structure 11. If the width of the first portion 31*a* is increased, the protruding amount of the end portion 16 may need to be increased. This may cause increase in size of the head 10. The flow channel structure 11 has a relatively higher thermal conductivity than the supply channel structure 12. Thus, although the first portion 31*a* of the first heater 31 has a relatively small heat generator, the first heater 31 may heat the ejection channels 42 appropriately. Consequently, the first portion 31*a* may preferably have a smaller width than the width of the second portion 31*b*.

The protruding amount of the end portion 16 is not limited specifically. In view of avoiding increase of size of the head 10, it may be enough that the end portion 16 protrudes approximately a few millimeters (e.g., between 1 mm and 2 mm). More specifically, for example, in a case where the side surface of the flow channel structure 11 has a height of (i.e., the flow channel structure 11 has a thickness of) approximately 400 to 500 μm (i.e., approximately 0.4 to 0.5 mm), the protruding amount of the end portion 16 may be approximately between 1000 μm and 1500 μm (i.e., approximately between 1 and 1.5 mm).

The flow channel structure 11 is made of inorganic material having a higher thermal conductivity than the material used for the supply channel structure 12. For example, the flow channel structure 11 may be a silicon substrate. Thus, although the first portion 31*a* of the first heater 31 is placed at the small protruding portion (e.g., the end portion 16) of a few millimeters, the first heater 31 may heat liquid such as ink appropriately. In this disclosure, the first heater 31 is attached to at least the end portion 16. The first heater 31 may thus have a larger heat generator for heating the flow channel structure 11 as compared with a known configuration in which a heater is attached to the side surface of the supply channel structure 12 only. Consequently, the first heater 31 may heat the flow channel structure 11 more effectively.

Figure 3A:
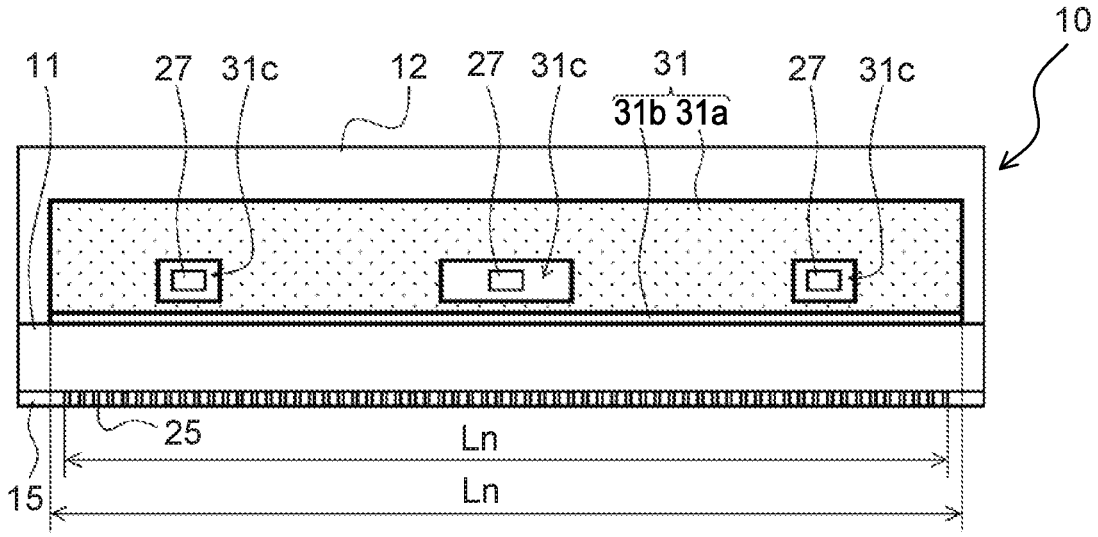
FIG. 3A is a schematic side view of the head of FIG. 1 illustrating a comparison between a length of a heater and a length of a nozzle row according to the illustrative embodiment of the disclosure.

A length (e.g., a dimension of sides extending in the longitudinal direction) of the first heater 31 is not limited specifically. For example, as illustrated in FIG. 3A, the length of the first heater 31 may preferably be greater than a length of the nozzle row in which the nozzles 25 are arranged. In FIG. 3A, it is assumed that the length of the first heater 31 is Lh and the length of the nozzle row is Ln. In such a case, it is preferable that Lh>Ln. Both ends of the first heater 31 in the longitudinal direction protrude relative to respective ends of the nozzle row in the longitudinal direction. As described above, the first heater 31 is longer in length than the nozzle row. Thus, the first heater 31 may be attached to the flow channel structure 11 or both of the flow channel structure 11 and the supply channel structure 12 while the both ends of the first heater 31 protrude relative to the respective ends of the nozzle row in the longitudinal direction. Consequently, temperature decrease of liquid flowing through the ejection channels 42 corresponding to the ends of the nozzle row may be reduced or prevented.

The head according to this disclosure may preferably include a plurality of temperature sensors such as the thermistors 27 for measuring temperature of the supply channel structure 12. For example, as illustrated in FIG. 2, the head 10 includes three thermistors 27. The thermistors 27 are disposed at the side surface of the supply channel structure 12. More specifically, for example, the thermistors 27 may be positioned at a middle portion and end portions of the side surface of the supply channel structure 12 in the longitudinal direction.

That is, the temperature sensors such as the thermistors 27 are positioned at a middle portion and end portions of the nozzle row. Such a configuration may thus enable the thermistors 27 to measure temperature of the supply channel structure 12 entirely along the nozzle row and the controller to use the measured temperatures for controlling driving of the first heater 31. Consequently, an occurrence of variations in heating temperature of the first heater 31 in the longitudinal direction may be reduced or prevented effectively. The number of temperature sensors provided at the head 10 is not limited to the specific example. In other embodiments, for example, four or more temperature sensors may be provided. In such a case, four or more temperature sensors may be disposed at respective different positions in the end portions and the middle portion of the side surface of the supply channel structure 12 in the longitudinal direction. The temperature sensors may be spaced at constant intervals.

If the thermistors 27 disposed at the end portions are positioned out of the first heater 31 in the longitudinal direction, the thermistors 27 may measure temperature of respective portions where the first heater 31 is not positioned. This may cause inappropriate control of the first heater 31 by the controller. Therefore, as illustrated in FIGS. 2 and 3A, the first heater 31 may preferably occupy surrounding areas of the thermistors 27 disposed at the end portions in the longitudinal direction. Thus, the first heater 31 may be disposed surrounding the temperature sensors such as the thermistors 27, thereby reducing or preventing decrease in temperature locally at the surrounding areas of the temperature sensors. Consequently, an occurrence of variations in heating temperature of the first heater 31 in the longitudinal direction may be reduced or prevented more effectively.

As illustrated in FIGS. 2 and 3A, the first heater 31 also occupies surrounding areas of the thermistor 27 disposed at the middle portion in the longitudinal direction. Placing the temperature sensors such as the thermistors 27 on the first heater 31 may enable the temperature sensors to directly measure temperature of heat generated by the first heater 31, but not temperature of the supply channel structure 12 heated by heat generated by the first heater 31. Thus, the first heater 31 has openings 31*c* at particular positions corresponding to appropriate placement positions of the thermistors 27. The thermistors 27 may be attached to respective portions of a particular surface of the supply channel structure 12 exposed through the openings 31*c* of the first heater 31.

The thermistors 27, the first heater 31, and the side surface structure of the supply channel structure 12 (e.g., the side wall of the supply channel structure 12 defining the manifold (e.g., the supply channel 41)) are not limited specifically. In one example, each thermistor 27 may have a size of approximately 2 by 2 $mm^2$. The first heater 31 may be a seat heater having a length of approximately 30 to 40 mm in the longitudinal direction. The side wall of the supply channel structure 12 may have a thickness of at least approximately 0.5 mm. The first heater 31 may be attached to the side wall of the supply channel structure 12 by a thermal conductive adhesive typically. If, however, the side wall is too thin, an adhesive allowance of the first heater 31 may not be enough, which may cause heat leakage. Thus, the side wall may preferably have a thickness of approximately 0.5 mm that may be thick enough to transfer heat generated by the first heater 31.

Figure 3B:
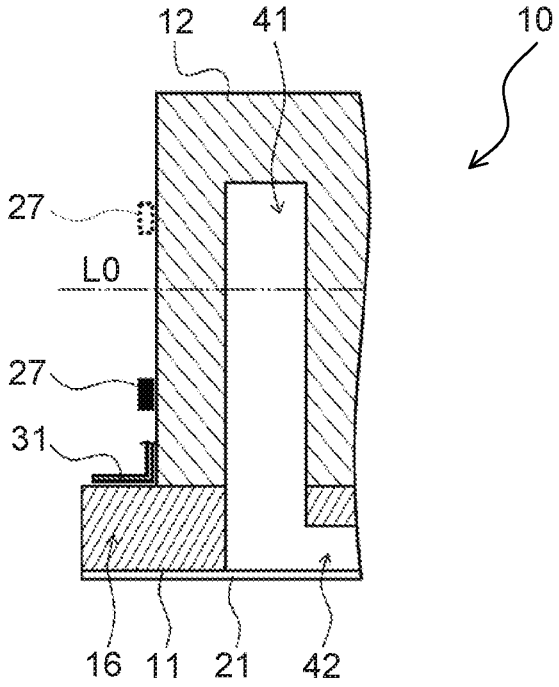
FIG. 3B is a schematic partial sectional side view illustrating placement examples of temperature sensors (e.g., thermistors) on a particular side surface of a supply channel structure of the head of FIG. 1 according to the illustrative embodiment of the disclosure.

The placement positions of the temperature sensors such as the thermistors 27 are not limited specifically. For example, as illustrated in FIG. 3B, it may be preferable that the thermistors 27 (only one of the thermistors 27 is illustrated) be positioned relatively close to the flow channel structure 11 at the side surface of the supply channel structure 12 (as indicated by the solid black thermistors 27). In FIG. 3B, for convenience in explaining the placement positions of the thermistors 27, the second portion 31 of the first heater 31 is illustrated partially.

If the thermistors 27 (only one of the thermistors 27 is illustrated) are positioned relatively far from the flow channel structure 11 (e.g., at an upper portion of the supply channel structure 12) as indicated by a dashed line, the thermistors 27 may measure temperature of the supply channel structure 12 at a position relatively far from the nozzles 25. In a case where the thermistors 27 are offset to the flow channel structure 11 side (e.g., positioned at a lower portion of the supply channel structure 12), the thermistors 27 may be positioned adjacent to the nozzles 25. Thus, the thermistors 27 may measure temperature of surrounding areas of the nozzles 25, thereby enabling the controller to control driving of the first heater 31 based on the measured temperatures. Consequently, an occurrence of variations in heating temperature of the first heater 31 may be reduced or prevented more effectively.

As indicated by a double-dotted-and-dashed line in FIG. 3B, a center line L0 is defined as the center line L0 passes through the center of the supply channel structure 12 in a direction perpendicular to the side surface of the supply channel structure 12. The center line L0 may be used as a reference for the placement positions of the thermistors 27. That is, the thermistors 27 may be offset to the flow channel structure 11 side with respect to the center line L0 (e.g., below the center line L0). In this disclosure, depending on the configuration of the head, the thermistors 27 may be positioned at respective positions as close as possible to the flow channel structure 11. Preferably, the thermistors 27 may be offset to the flow channel structure 11 side with respect to the center line L0, thereby enabling the thermistors 27 to measure temperature of the surrounding areas of the nozzles 25 at the positions closer to the nozzles 25.

Modifications

Referring to FIGS. 4A, 4B, 4C and 5, example modifications of heads 110 and 210 according to the one or more aspects of the disclosure will be described in detail.

In the example illustrated in FIGS. 1 and 2, the first heater 31 includes the first portion 31*a* and the second portion 31*b*. The first portion 31*a* is positioned at the upper surface of the end portion 16. The second portion 31*b* is positioned at the side surface of the supply channel structure 12. The first portion 31*a* and the second portion 31*b* of the first heater 31 are contiguous to each other and thus the first heater 31 has a one-piece structure (e.g., the first heater 31 has an L-shape in cross section in FIG. 1). Nevertheless, the configuration of the heater is not limited to the specific example. A heater having another configuration may be adopted. In the illustrative embodiment, the first heater 31 includes the first portion 31*a* and the second portion 31*b* that may serve as respective heat generators. In other words, the first heater 31 has two heat generators. Nevertheless, in one modification, for example, a heater may have three or more heat generators.

Figure 4A:
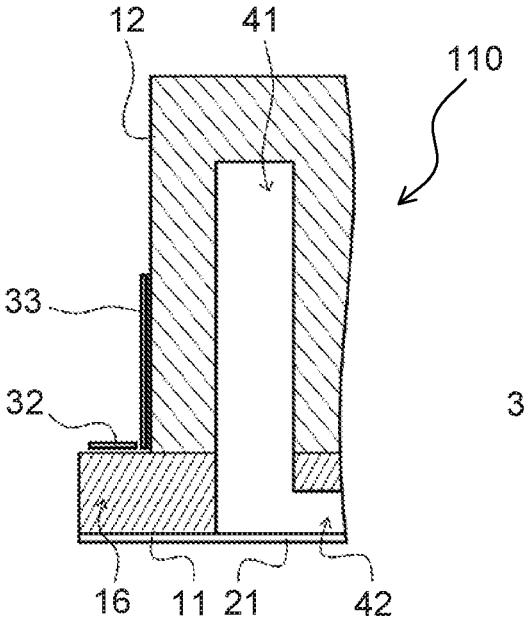
FIG. 4A is a schematic partial sectional side view of another head including heaters having another configuration according to a modification of the illustrative embodiment of the disclosure.

In another example, a plurality of heaters each having a single heat generator may be adopted. In such a case, for example, as illustrated in FIG. 4A, a head 110 may include a first heater 32 and a second heater 33. The first heater 32 may be attached to an end portion 16 of a flow channel structure 11. The second heater 33 may be attached to a side surface of a supply channel structure 12. In still another example, the first portion 31*a* and the second portion 31*b* of the first heater 31 may constitute a single heat generator and the first heater 31 may be bent to extend between the end portion 16 and the side surface of the supply channel structure 12.

The flow channel structure 11 and the supply channel structure 12 are separate members, and thus, the flow channel structure 11 and the supply channel structure 12 have different linear expansion coefficients. Thus, as illustrated in FIG. 4A, disposing the first heater 32 at the flow channel structure 11 and the second heater 33 at the supply channel structure 12 separately may reduce warping of the nozzle surface caused by the difference of the linear expansion coefficient between the flow channel structure 11 and the supply channel structure 12. Consequently, an occurrence of variations in landing positions of ink (e.g., liquid) droplets to be ejected from the head 110 may be reduced or prevented effectively. In addition, disposing the heaters 32 and 33 separately may reduce increase of stress caused by the difference in linear expansion coefficient between the flow channel structure 11 and the supply channel structure 12 at their joint surfaces. Consequently, the joint condition of the flow channel structure 11 and the supply channel structure 12 may be maintained in an appropriate condition.

Figure 4B:
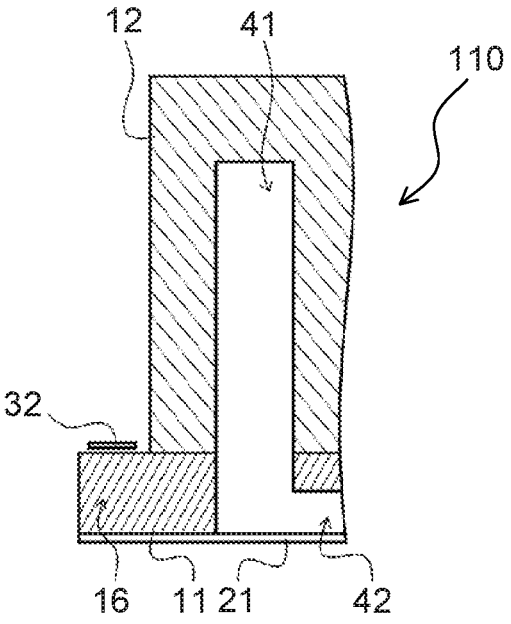
FIG. 4B is a schematic partial sectional side view of another head including a heater having another configuration according to another modification of the illustrative embodiment of the disclosure.

In the head according to the disclosure, a heater may be attached to at least the end portion 16. Thus, in yet another example, as illustrated in FIG. 4B, the head 110 may include only the first heater 32 attached to the end portion 16. In a further example, a head may include the first heater 32 and a plurality of heaters (or heat generators). The first heater 32 may be attached to the end portion 16. The plurality of heaters (or the heat generators) may be attached to the side surface of the supply channel structure 12 independently of the first heater 32. The side surface of the supply channel structure 12 has a larger area than the end portion 16 of the flow channel structure 11, and therefore, a plurality of heaters or heat generators may be disposed at the side surface of the supply channel structure 12 in accordance with the configuration of the supply channel 41. Such a configuration may thus enable the heaters or the heat generators to heat the supply channel 41 appropriately.

The heaters 32 and 33 of FIGS. 4A and 4B may be elongated along the longitudinal direction as with the first heater 31. Nevertheless, in this disclosure, the shapes of the heaters 32 and 33 are not limited to the specific example. Such heaters elongated along the longitudinal direction might not necessarily be adopted. Heaters that may be relatively short in the longitudinal direction may be adopted. Hereinafter, such heaters may be referred to as short heaters. In one example, a plurality of short heaters 32 may be attached to the end portion 16 along the longitudinal direction. In another example, a plurality of short heaters 32 may be attached to the side surface of the supply channel structure 12 along the longitudinal direction.

Figure 4C:
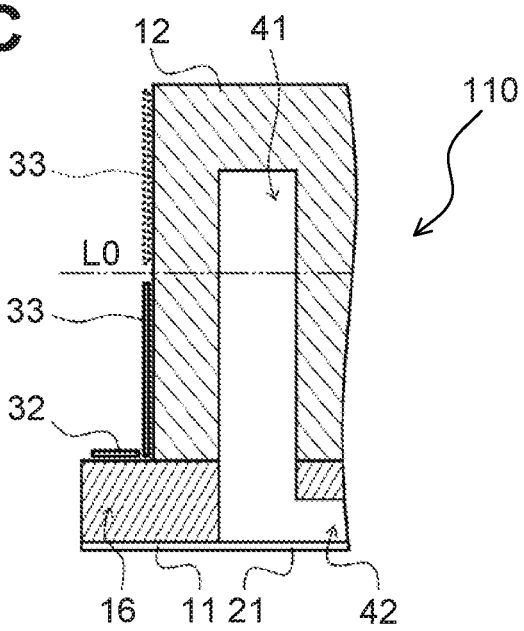
FIG. 4C is a schematic partial sectional side view illustrating placement examples of the heaters on a particular side surface of a supply channel structure of the head of FIG. 4A according to the modification of the illustrative embodiment of the disclosure.

In a case where the second heater 33 is attached to the side surface of the supply channel structure 12 independently of the first heater 32, as indicated by a solid line in FIG. 4C, the second heater 33 may preferably be offset to the flow channel structure 11 side at the side surface of the supply channel structure 12 as with the temperature sensors such as the thermistors 27. The second heater 33 may be disposed in a continuous manner. If the second heater 33 is positioned relatively far from the flow channel structure 11 (e.g., at the upper portion of the supply channel structure 12) as indicated by a dashed line, the second heater 33 may heat the supply channel structure 12 at a position relatively far from the nozzles 25.

In a case where the second heater 33 is offset to the flow channel structure 11 side (e.g., positioned at a lower portion of the supply channel structure 12), the second heater 33 may be positioned adjacent to the nozzles 25. The second heater 33 is also elongated along the longitudinal direction as with the first heater 32 of the illustrative embodiment. The second heater 33 may thus disposed at the lower portion of the supply channel structure 12 in a continuous manner Such a configuration may thus enable the second heater 33 to heat the portion of the supply channel structure 12 relatively close to the nozzles 25 entirely, thereby reducing or preventing an occurrence of variations in heating temperature of the second heater 33 more effectively.

As with the reference for the placement positions of the thermistors 27, as indicated by a double-dotted-and-dashed line in FIG. 4C, a center line L0 is defined as the center line L0 passes through the center of the supply channel structure 12 in a direction perpendicular to the side surface of the supply channel structure 12. The center line L0 may be used as a reference for the placement positions of the second heater 33. That is, the second heater 33 may be offset to the flow channel structure 11 side with respect to the center line L0 (e.g., below the center line L0). In a case where the first heater 31 is adopted, once the first portion 31*a* of the first heater 31 is placed at the upper surface of the end portion 16 of the flow channel structure 11, the second portion 31*b* of the first heater 31 may be positioned offset to the flow channel structure 11 (e.g., at the lower portion of the supply channel structure 12) inevitably as the second portion 31*b* is contiguous to the first portion 31*a*. In a case where the separate heaters 32 and 33 are adopted, the second heater 33 may be positioned offset to the flow channel structure 11 with respect to the center line L0, thereby enabling the second heater 33 to heat ink at the position adjacent to the nozzles 25.

Figure 5:
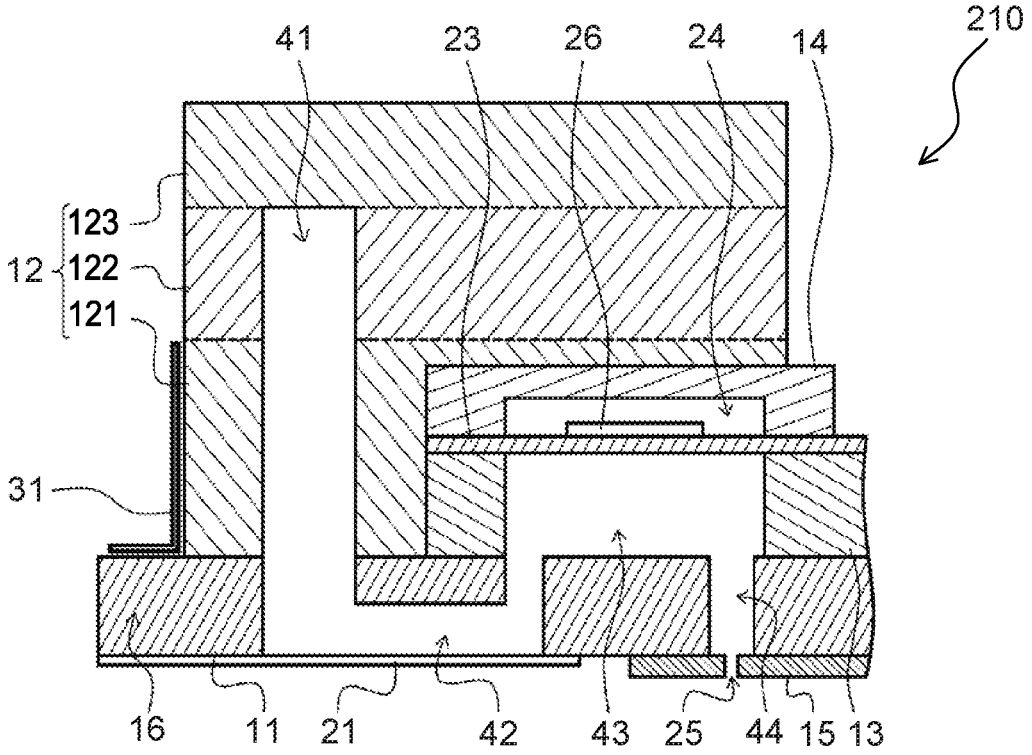
FIG. 5 is a schematic partial sectional view of another head including a supply channel structure having another configuration according to another modification of the illustrative embodiment of the disclosure.

The heads 10 and 110 having the above configuration each include the supply channel structure 12 made of resin material having a relatively low thermal conductivity or inorganic material and have a single layer structure. The structure of the supply channel structure 12 is not limited to the specific example. Nevertheless, as illustrated in FIG. 5, a head 210 may have a supply channel structure 12 made of resin material and have a multi-layer structure.

For example, the supply channel structure 12 may have a three layer structure including a first layer 121, a second layer 122, and a third layer 123 laminated one above another in this order from below. The first layer 121 may be positioned closest to the flow channel structure 11 among the three layers 121, 122, and 123. Nevertheless, in another example, the supply channel structure 12 may have another multi-layer structure including two or four or more layers. In a case where the supply channel structure 12 has a multi-layer structure made of resin material, heat shrinkage that may influence the supply channel structure 12 may be reduced. Consequently, the joint condition of the flow channel structure 11 and the supply channel structure 12 may be maintained in an appropriate condition.

According to one or more aspects of the disclosure, as described above, a head may include a flow channel structure, a supply channel structure, and a heater. The flow channel structure may define an ejection channel that may lead liquid toward a plurality of nozzles arranged in a nozzle row along a first direction. The supply channel structure may define a supply channel configured to allow liquid to flow therefrom to the ejection channel. The heater may be configured to heat liquid. The flow channel structure may be made of inorganic material having a higher thermal conductivity than material used for the supply channel structure. The flow channel structure may include an end portion protruding outward relative to a side surface of the supply channel structure. The heater may be disposed at the end portion of the flow channel structure.

In the head having the above configuration, the heater may be disposed at the end portion of the flow channel structure protruding outward relative to the side surface of the supply channel structure. That is, the heater may be disposed at the flow channel structure having a higher thermal conductivity than the supply channel structure. Such a configuration may thus enable the heater to apply heat to a manifold (e.g., the supply channel) of the supply channel structure effectively, thereby heating liquid such as ink appropriately.

In the known head, a heater may be disposed at a supply channel structure only and a flow channel structure fixed to the supply channel structure may have a relatively good thermal conductivity. Such a configuration may however cause the flow channel structure to dissipate heat of liquid (e.g., ink) heated in the supply channel structure, which may influence appropriate heat application to liquid. On the other hand, in the head according to the one or more aspects of the disclosure, the heater may be disposed at at least the end portion of the flow channel structure. Thus, even if the flow channel structure is made of inorganic material having a higher thermal conductivity than the material used for the supply channel structure, the flow channel structure may be heated directly by the heater. Such a configuration may thus effectively reduce dissipation of heat of ink heated in the supply channel structure that may occur in the known head, thereby enabling the heater to heat liquid such as ink appropriately.

While the disclosure has been described in detail with reference to the specific embodiment thereof, this is merely an example, and various changes, arrangements and modifications may be applied therein without departing from the spirit and scope of the disclosure. The particular elements and features disclosed in the illustrative embodiment and the modifications or variations may be combined with each other in other ways without departing from the spirit and scope of the disclosure.

The disclosure may be suitable for liquid ejection heads of liquid ejection apparatuses configured to eject liquid such as ink.

What is claimed is:

1. A liquid ejection head comprising:

a flow channel structure defining an ejection channel that leads liquid toward a plurality of nozzles arranged in a nozzle row along a first direction;

a supply channel structure defining a supply channel configured to allow liquid to flow therefrom to the ejection channel; and a first heater configured to heat liquid, wherein the flow channel structure is made of inorganic material having a higher thermal conductivity than material used for the supply channel structure, wherein the flow channel structure includes an end portion protruding outward relative to a side surface of the supply channel structure, and wherein the first heater is attached to the end portion of the flow channel structure.

2. The liquid ejection head according to claim 1, wherein the first heater includes a first portion and a second portion, wherein the first portion is attached to the end portion of the flow channel structure, and wherein the second portion is attached to the side surface of the supply channel structure.

3. The liquid ejection head according to claim 2, wherein the first portion and the second portion of the first heater each have a heat generator.

4. The liquid ejection head according to claim 2, wherein, a dimension of sides of each of the first portion and the second portion of the first heater extending along a second direction perpendicular to the first direction is defined as a width, a width of the second portion being greater than a width of the first portion.

5. The liquid ejection head according to claim 2, further comprising a plurality of temperature sensors, wherein the temperature sensors are attached to at least a middle portion and end portions of the side surface of the supply channel structure in the first direction.

6. The liquid ejection head according to claim 5, wherein the second portion of the first heater occupies surrounding areas of the temperature sensors.

7. The liquid ejection head according to claim 5, wherein the temperature sensors are positioned relatively close to the flow channel structure at the side surface of the supply channel structure.

8. The liquid ejection head according to claim 1, wherein the supply channel structure has a multi-layer structure made of resin material.

9. The liquid ejection head according to claim 1, wherein the first heater is elongated along the first direction and has longer sides extending along the first direction, and wherein a length of the longer sides of the first heater is greater than a length of the nozzle row.

10. The liquid ejection head according to claim 1, wherein the flow channel structure and the supply channel structure are joined to each other using an adhesive that has a higher thermal conductivity than the material used for the supply channel structure.

11. The liquid ejection head according to claim 1, further comprising a second heater, wherein the second heater is spaced away from the flow channel structure and attached to the side surface of the supply channel structure in a continuous manner.

12. The liquid ejection head according to claim 11, wherein the first heater is spaced away from the side surface of the supply channel structure.

13. The liquid ejection head according to claim 11, wherein the second heater is spaced away from the first heater.

14. The liquid ejection head according to claim 1, further comprising a damper disposed at the flow channel structure, wherein the material used for the supply channel structure has a higher thermal conductivity than material used for the damper disposed.

15. The liquid ejection head according to claim 14, wherein the material used for the supply channel structure is alumina ($Al_2O_3$).

* * * * *